United States Patent [19]

Law

[11] Patent Number: 4,941,262

[45] Date of Patent: Jul. 17, 1990

[54] CAN OPENER

[75] Inventor: Tony Y. M. Law, Kowloon, Hong Kong

[73] Assignee: Emmarco Industries Co., Ltd., Kowloon, Hong Kong

[21] Appl. No.: 428,615

[22] Filed: Oct. 30, 1989

[51] Int. Cl.[5] ..... B26B 17/02

[52] U.S. Cl. ..... 30/419; 30/400; 81/367

[58] Field of Search ..... 30/414, 415, 416, 419, 30/429, 181, 400; 81/300, 367

[56] References Cited

U.S. PATENT DOCUMENTS

| | | | |
|---|---|---|---|
| 689,846 | 12/1901 | Benchemin | 30/415 |
| 1,802,443 | 4/1931 | Nagano | 30/416 |
| 1,870,938 | 8/1932 | Winans | 30/416 |
| 2,262,645 | 11/1941 | Newman | 30/181 |

FOREIGN PATENT DOCUMENTS

| | | | |
|---|---|---|---|
| 832236 | 4/1960 | United Kingdom . | |
| 927868 | 6/1963 | United Kingdom | 30/415 |
| 2170172A | 7/1989 | United Kingdom . | |

*Primary Examiner*—Frank T. Yost
*Assistant Examiner*—Willmon Fridie, Jr.
*Attorney, Agent, or Firm*—Christie, Parker & Hale

[57] ABSTRACT

The can opener has two support members (10 and 11), a rotatable drive wheel (17) on one of the support members (10) for advancing the opener around a can, a cutting blade (18) on the other member (11), and two handles (13 and 14) for pivoting the support members (10 and 11) between closed and open configurations. The can opener also comprises an over center toggle linkage (15 and 16) so that when the support members are in a closed configuration the support members cannot be moved to an open configuration by a force applied between the drive wheel (17) and the cutting blade (18).

6 Claims, 2 Drawing Sheets

CAN OPENER

This invention relates to a can opener.

It is known to provide a can opener having two members connected together in scissor-like manner, a drive wheel on one member for advancing the can opener around a can and a cutting blade on the other member. This known can opener has the disadvantage that the user has to apply constant pressure to the two members when opening a can to prevent the drive wheel and blade separating.

In seeking to mitigate this drawback, the present invention provides a can opener comprising first and second support members, a rotatable drive wheel on one of the support members for advancing the opener around a can, a cutting blade on the other support member, the first and second support members being pivotable relative to one another between a closed configuration in which the cutting blade co-operates with the drive wheel to cut the can and an open configuration in which the cutting blade and drive wheel are separated to facilitate attachment of the opener to and detachment of the opener from the can, a first toggle link pivotably connected to the first support member about a first pivot axis, a second toggle link pivotably connected to the second support member about a second pivot axis and to the first toggle link about a third pivot axis, a first handle secured to or integral with the first support member and a second handle secured to or integral with one of the toggle links, the arrangement being such that movement of the second handle towards the first handle will move the support members to said closed configuration and movement of the second handle away from the first handle will move the support members to said open configuration and being such that when the support members are in said closed configuration and a force is applied between the cutting blade and the drive wheel in a sense to move the blade and wheel apart the support members will remain in said closed configuration.

Preferred and/or optional features of the invention are set forth in claims 2 to 5, inclusive.

Figure 1:
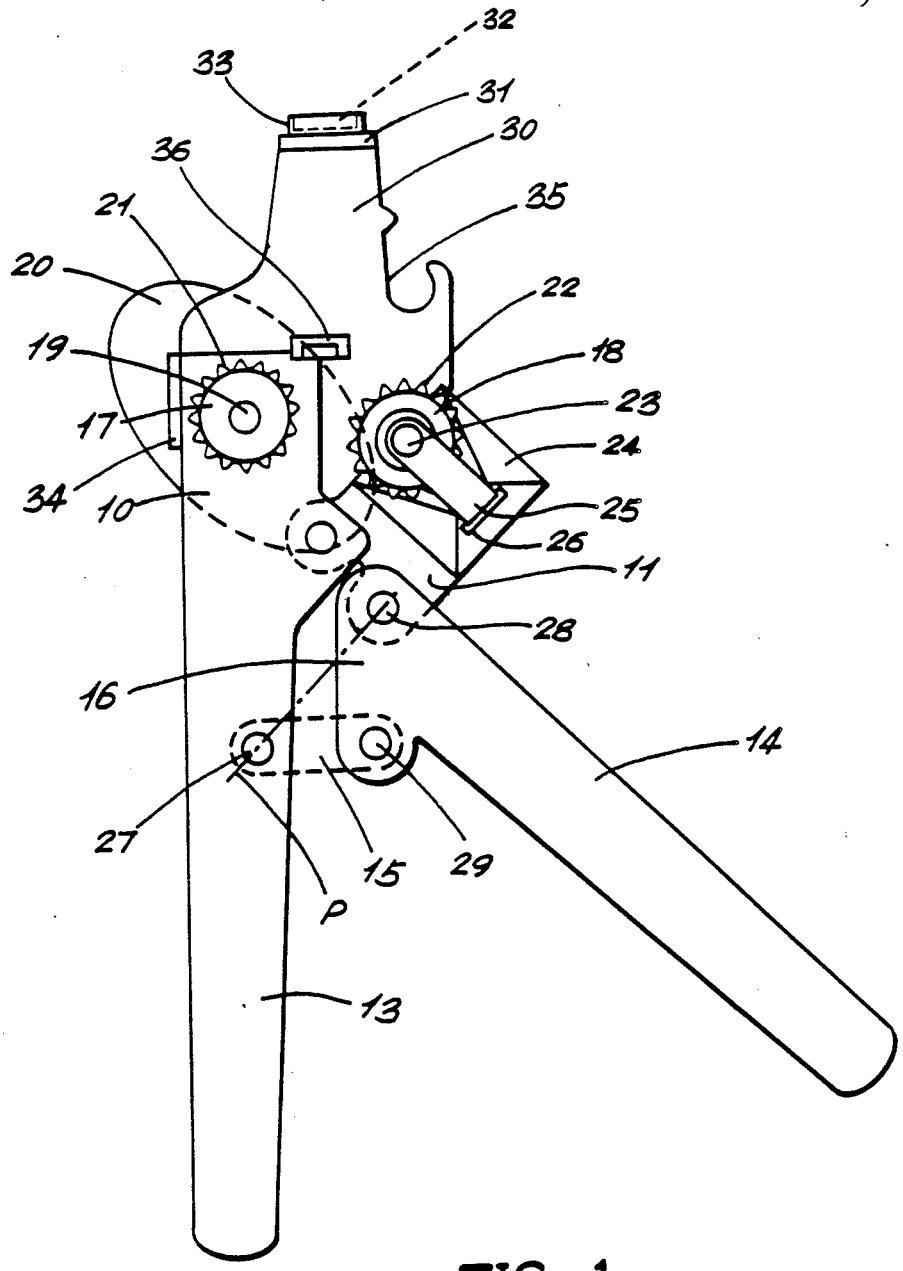
Figure 2:
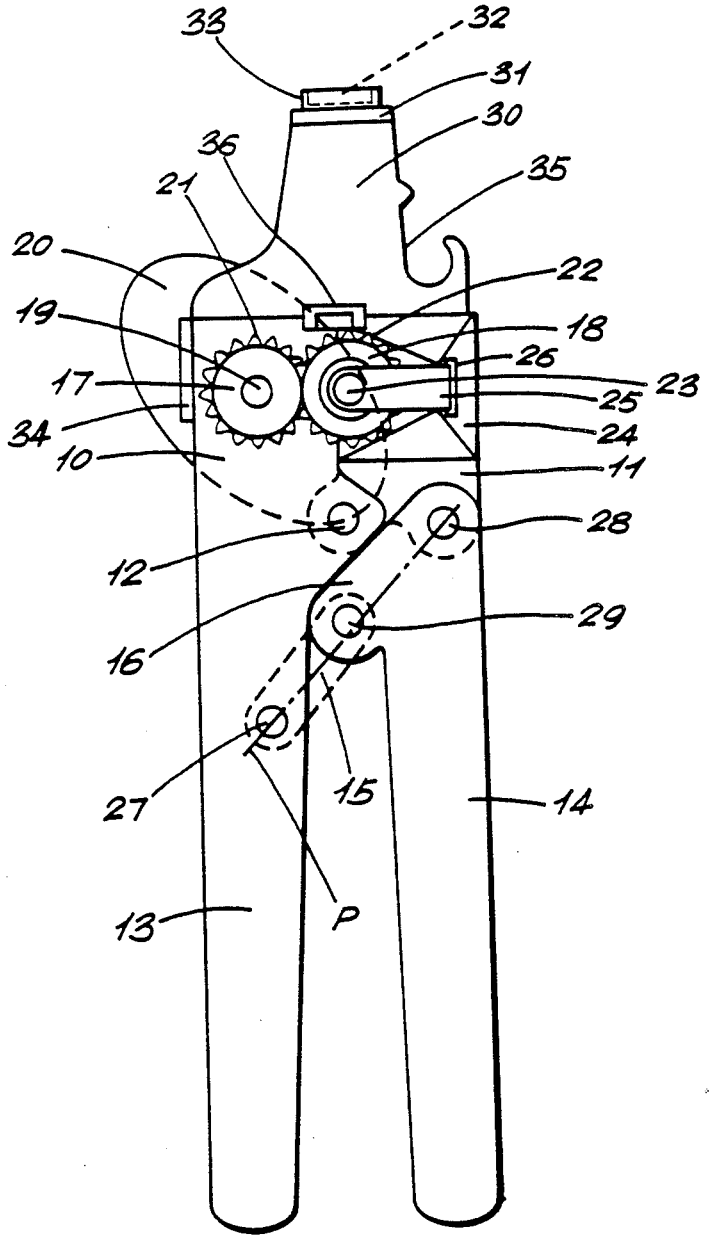

The invention will now be more particularly described, by way of example, with reference to the accompanying drawings, in which:

FIG. 1 is a plan view of one embodiment of a can opener according to the invention, showing the drive wheel and the cutting blade separated, and FIG. 2 is a view similar to FIG. 1, but showing the drive wheel and the cutting blade closed together.

Referring now to the drawings, the can opener shown therein comprises first and second support members 10 and 11, respectively, pivotably connected together by a rivet 12, first and second handles 13 and 14, respectively, and an over centre toggle linkage comprising first and second toggle links 15 and 16.

A rotatable drive wheel 17 is mounted on the support 10 for advancing the opener around a can and a circular cutting blade 18 is mounted on the support 11. The drive wheel 17 has a serrated peripheral surface and is keyed to a shaft 19 rotatable by an operating member in the form of a knob 20. A toothed wheel 21 is also keyed to the shaft 19, the wheel 21 being interposed between the drive wheel 17 and the support 10. The cutting blade 18 is secured to a further toothed wheel 22 and the blade 18 and wheel 22 are freely rotatable on a shaft 23.

The shaft 19 is rotatable about an axis perpendicular to the plane of movement of the two support members 10 and 11 whilst the shaft 23 is secured to an inclined surface of a protruberance 24 on the support 11 so that the blade 18 is inclined towards the drive wheel 17 when the support members 10 and 11 are in a closed configuration as shown in FIG. 2. The cutting blade 18 and toothed wheel 22 are held on the shaft 23 by a spring clip 25 fixed at one end in an aperture 26 in the protruberance 24 and fitted at the other end over the shaft 23.

One end of the first toggle link 15 is pivotably connected to the first support member 10 about a pivot axis 27 and one end of the second toggle link 16 is pivotably connected to the second support member about a pivot axis 28. The other ends of the first and second toggle links 15 and 16 are pivotably connected together about a pivot axis 29.

The handle 13 is integral with the support member 10 and the handle 14 is integral with the toggle link 16. However, the handles 13 and 14 could instead be secured to the support member 10 and the toggle link 16, respectively.

A plate-like member 30 is secured to the support member 10. The plate-like member 30 has an integral boss (not shown) defining a bearing seat for a bearing supporting the shaft 19. The member 30 also has an upturned flange 31 which supports a permanent magnet 32 in a magnet housing 33, an upturned flange 34 which bears against a can during an opening operation, a portion 35 defining a bottle opener, and a guide 36 which overlies end portions of the support members 10 and 11 when the latter are in a closed configuration to limit relative displacement of the support members 10 and 11 in a direction transverse to the plane of relative movement of the support members 10 and 11.

In operation, the can opener is placed on a can in conventional manner and the handles 13 and 14 are drawn together so that the cutting blade 18 pierces the top of the can lid within the rim of the can and the drive wheel 17 engages the underside of the can rim. Rotation of the knob 20 will cause the can opener to advance around the can and the blade 18 will open the can.

As the handles 13 and 14 are drawn together it will be seen from the drawings that the pivot axis 29 crosses or at least moves into a plane P passing through the pivot axes 27 and 28. As a result of this the support members 10 and 11 cannot be moved from a closed to an open configuration by a force applied between the drive wheel 17 and the cutting blade 18. Therefore, it is not necessary for a user to apply constant pressure to the handles 13 and 14 when opening a can.

The above embodiment is given by way of example only and various modifications will be apparent to persons skilled in the art without departing from the scope of the invention defined by the appended claims.

I claim:

1. A can opener comprising first and second support members, a rotatable drive wheel on one of the support members for advancing the opener around a can, a cutting blade on the other support member, the first and second support members being pivotable relative to one another between a closed configuration in which the cutting blade co-operates with the drive wheel to cut the can and an open configuration in which the cutting blade and drive wheel are separated to facilitate attachment of the opener to and detachment of the opener from the can, a first toggle link pivotably connected to the first support member about a first pivot axis, a second toggle link pivotably connected to the second support member about a second pivot axis and to the first toggle link about a third pivot axis, a first handle secured to or integral with the first support member and a second handle secured to or integral with one of the toggle links, the arrangement being such that movement of the second handle towards the first handle will move the support members to said closed configuration and movement of the second handle away from the first handle will move the support members to said open configuration and being such that when the support members are in said closed configuration and a force is applied between the cutting blade and the drive wheel in a sense to move the blade and wheel apart the support members will remain in said closed configuration.

2. A can opener as claimed in claim 1, wherein the drive wheel is on the first support member and the cutting blade is on the second support member.

3. A can opener as claimed in claim 1, further comprising an operating member for rotating the drive wheel.

4. A can opener as claimed in claim 1, wherein the second handle is secured to or integral with the second toggle link.

5. A can opener as claimed in claim 1, wherein the cutting blade is circular and the drive wheel and cutting blade have associated gears which intermesh when the support members are in a closed configuration so that rotation of the drive wheel will effect rotation of the cutting blade.

6. A can opener as claimed in claim 1, wherein the third pivot axis lies in or to one side of a plane passing through the first and second pivot axes when the support members are in said closed configuration and wherein the third pivot axis lies on the other side of the plane passing through the first and second pivot axes when the support members are in an open configuration.

* * * * *